US006009384A

United States Patent [19]

Veldhuis et al.

[11] Patent Number: 6,009,384

[45] Date of Patent: Dec. 28, 1999

[54] METHOD FOR CODING HUMAN SPEECH BY JOINING SOURCE FRAMES AND AN APPARATUS FOR REPRODUCING HUMAN SPEECH SO CODED

[75] Inventors: Raymond N. J. Veldhuis; Paul A. P. Kaufholz, both of Eindhoven, Netherlands

[73] Assignee: U.S. Philips Corporation, New York, N.Y.

[21] Appl. No.: 08/859,593

[22] Filed: May 20, 1997

[30] Foreign Application Priority Data

May 24, 1996 [EP] European Pat. Off. ..... 96201449

[51] Int. Cl.[6] ..... G10L 9/00

[52] U.S. Cl. ..... 704/201; 704/219; 704/222; 704/223; 704/224; 704/238

[58] Field of Search ..... 704/201, 200, 704/219, 222, 223, 224, 238

[56] References Cited

FOREIGN PATENT DOCUMENTS

0557940A2 1/1993 European Pat. Off. ..... G10L 9/14

0607989A2 7/1994 European Pat. Off. ..... G10L 9/14

OTHER PUBLICATIONS

Rabiner et al. Fundamentals of Speech Recognition, pp. 174–176, Jan. 1, 1993.

"An Introduction to Source Coding", by Raymond Veldhuis et al., Prentice Hall, 79–81.

*Primary Examiner*—David R. Hudspeth
*Assistant Examiner*—Susan Wieland

[57] ABSTRACT

For coding human speech for subsequent audio reproduction thereof, a plurality of speech segments is derived from speech received, and systematically stored in a data base for later concatenated readout. After the deriving, respective speech segments are fragmented into temporally consecutive source frames, similar source frames as governed by a predetermined similarity measure thereamongst that is based on an underlying parameter set are joined, and joined source frames are collectively mapped onto a single storage frame. Respective segments are stored as containing sequenced referrals to storage frames for therefrom reconstituting the segment in question.

7 Claims, 5 Drawing Sheets

METHOD FOR CODING HUMAN SPEECH BY JOINING SOURCE FRAMES AND AN APPARATUS FOR REPRODUCING HUMAN SPEECH SO CODED

BACKGROUND TO THE INVENTION

The invention relates to a method for coding human speech for subsequent audio reproduction thereof, said method comprising the steps of deriving a plurality of speech segments from speech received, and systematically storing said segments into a data base for later concatenated readout. Memory-based speech synthesizers reproduce speech by concatenating stored segments; furthermore, for certain purposes, pitch and duration of these segments may be modified. The segments, such as diphones, are stored into a data base. For later reproducing the speech, many systems, such as mobile or portable systems, allow only a quite limited storage capacity, for keeping low the cost and/or weight of the apparatus. Therefore, source-coding methods can be applied to the segments so stored. Such source coding will then however often result in a relatively degraded segmental quality when the segments are concatenated and/or their pitch and/or duration are modified. It has in consequence been found necessary to combine reduced storage requirements with a speech quality that is less degraded in such a source coding organization.

SUMMARY TO THE INVENTION

Accordingly, amongst other things, it is an object of the present invention to organize the storage of the speech segments in such a way that an improved trade-off will be realized as evaluated on the basis of input-output analysis. Now therefore, according to one of its aspects, the invention is characterized in that, after said deriving, respective speech segments are fragmented into temporally consecutive source frames, similar source frames as governed by a predetermined similarity measure thereamongst, that is based on an underlying parameter set are joined, joined source frames are collectively mapped onto a single storage frame, and respective segments are stored as containing sequenced referrals to storage frames for therefrom reconstituting the segment in question. Through the joining of various source flames and the successive mapping thereof onto storage frames, the modelling of each storage frame can retain its quality in such manner that concatenated frames will retain a relatively high reproduction quality, while storage space can be diminished to a large extent.

The invention also relates to an apparatus for reproducing human speech through memory accessing of code book means for retrieving of concatenatable speech segments, wherein the similarity measure bases on calculating a distance quantity:

$$D(\underline{a}_k, \underline{a}_1) = \frac{1}{2\pi}\int_{-\pi}^{\pi}\left|\frac{A_k(\exp(j\theta))}{A_l(\exp(j\theta))}\right|^2 d\theta \times \sigma_l^2,$$

wherein $$A_k(z) = 1 + \sum_{m=1}^{p_k} a_{k,m} z^{-m},$$

indicating how well $a_k$ performs as a prediction filter for a signal with a spectrum given by $\{1/|A_l(\exp(j\theta))|^2\}$.

Various further advantageous aspects of the invention are recited in dependent Claims.

BRIEF DESCRIPTION OF THE DRAWING

These and further aspects and advantages of the invention will be discussed in detail hereinafter with reference to the disclosure of preferred embodiments, and in particular with reference to the appended Figures that show.

DETAILED DESCRIPTION OF PREFERRED EMBODIMENTS

Figure 1:
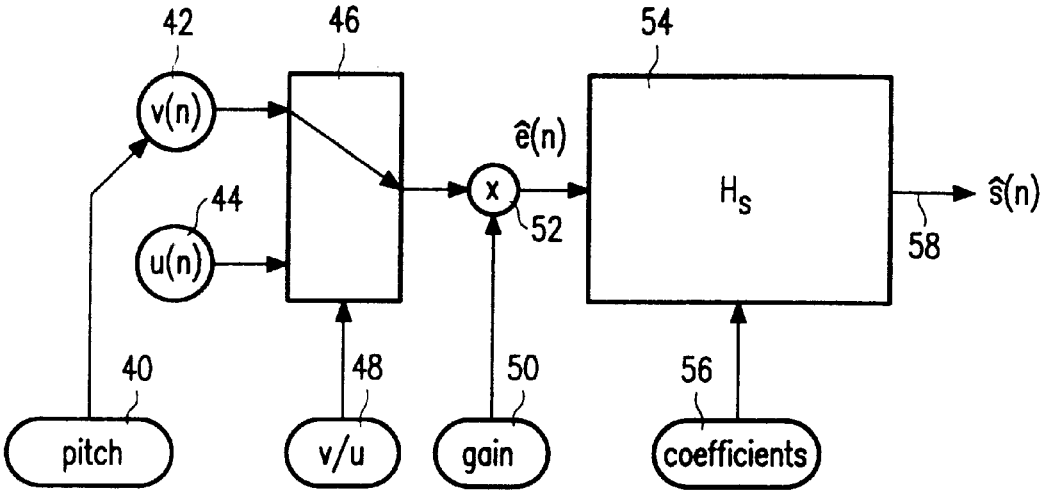
FIG. 1 PRIOR ART
FIG. 1, a known monopulse vocoder.

The speech segments in the data base are built up from smaller speech entities called frames that have a typical uniform duration of some 10 msec; the duration of a full segment is generally in the range of 100 msec, but need not be uniform. This means that various segments may have different numbers of frames, but often in the range of some ten to fourteen. The speech generation now will start from the synthesizing of these frames, through concatenating, pitch modifying, and duration modifying as far as required for the application in question. A first exemplary frame category is the LPC frame, as will be discussed with reference to FIGS. 1–3. A second exemplary frame category is the PSOLA bell, as will be discussed with reference to FIG. 4. The overall length of such bell is substantially equal to two local pitch periods; the bell is a windowed segment of speech centered on a pitch marker. In unvoiced speech the arbitrary pitch markers must be defined without recourse to actual pitch. Because outright storage of such PSOLA bells would require double storage capacity, they are not stored individually, but rather extracted from the stored segments before manipulation of pitch and/or duration. For the remainder of the present discussion, the PSOLA bells will however be referred to as stored entities. This approach is viable if the proposed source coding method yields a sufficient storage reduction.

The present technology is based on the fact now recognized that there are strong similarities between respective frames, both within a single segment, and among various different segments, provided the similarity measure is based on the similarities within underlying parameter sets. The storage reduction is then attained by replacing various similar frames by a single prototype frame that is stored in a code book. Each segment in the data base will then consist of a sequence of indices to various entries in the code book. The sections hereinafter explain the principle for LPC vocoders and PSOLA-based systems, respectively.

An LPC-Vocoder-Based Preferred Embodiment

Frames in LPC vocoders contain information regarding voicing, pitch, gain, and information regarding the synthesis filter. The storing of the first three informations requires only little space, relative to the storing of the synthesis filter properties. The synthesis filter is usually an all-pole filter, cf. FIG. 1, and can be represented according to various different principles, such as by prediction coefficients (so-called A-parameters), reflection coefficients (so-called K-parameters), second order sections containing so-called PQ parameters, and line spectral pairs. Since all these representations are equivalent and can be transformed into each other, the discussion hereinafter is without restrictive prejudice based on storing the prediction coefficients. The order of the filter is usually in the range between 10 and 14, and the number of parameters per filter is equal to the above order.

Now, first the distance between two frames, as represented by their sets of prediction coefficients, is to be specified, and furthermore, a policy to derive a code book must be set. A vector a constructed from various prediction coefficients is called a prediction vector, according to $a=(1, a_1, a_2, \ldots a_p)^T$, wherein p is the order of prediction, and the superscript T denotes transposition. Between two prediction vectors $a_k$ and $a_1$, the associated distance measure $D(a_k, a_l)$ is defined as:

$$D(\underline{a}_k, \underline{a}_1) = \frac{1}{2\pi}\int_{-\pi}^{\pi}\left|\frac{A_k(\exp(j\theta))}{A_l(\exp(j\theta))}\right|^2 d\theta \tag{1}$$

which can be multiplied by an 1-dependent variance factor $\sigma_1^2$ that for a simplified approach may have a uniform value equal to 1. In the above, $A_k(z)$ can be advantageously defined according to:

$$A_k(z) = 1 + \sum_{m=1}^{p_k} a_{k,m} z^{-m}, \tag{2}$$

This distance quantity is not symmetrically commutable. The interpretation of the distance is that it indicates how well $a_k$ performs as a prediction filter for a signal with a spectrum given by $\{1/|A_l(\exp(j\theta))|^2\}$. When comparing the prediction coefficients of a frame with the prediction coefficients present in the code book, we must evaluate $D(a_{code\ book}, a_{frame})$.

An alternative and practical manner of calculating the above distance measure is through the autocorrelation matrix $R_l$ corresponding to $a_l$. This matrix can be derived from the quantity $a_l$ in a straightforward manner. The distance measure then follows from:

$$D(a_k, a_l) = a_k^T R_l a_k \tag{3}$$

During the generating of the code book, the prediction vectors as well as the various correlation matrices are used. A particular method of preparing a code book has been published by Linde-Buzo-Gray, as discussed in an instructive manner in the book An introduction to Source Coding by Raymond Veldhuis and Marcel Breeuwer, Prentice Hall International, 1993 Hemel Hampstead UK, pp.79–81. The method starts from an initial code book and furthermore, from the collection of all prediction vectors. The latter collection is partitioned by assigning each vector to that particular code book vector that has the smallest distance to it. Subsequently, a new code book is formed from the centroids of the partitions. Such centroid is the vector that minimizes $$\underline{a}^T\left(\sum_{m\in\text{partition}} R_m\right)\underline{a} \tag{4}$$

This vector is produced as the solution of a linear system of equations. The above procedure is repeated until the code book has become sufficiently stable, but the procedure is rather tedious. Therefore, an alternative is to produce a number of smaller code books that each pertain to a subset of the prediction vectors. A straightforward procedure for effecting this division into subsets is to do it on the basis of the segment label that indicates the associated phoneme. In practice, the latter procedure is only slightly less economic.

PSOLA-Based Synthesis

For this policy, the procedure to obtain a code book can be the same as in the case of the LPC vocoder. The distance measure is however specified in a somewhat different manner. For example, each PSOLA bell can be conceptualized as a single vector, and the distance as the Euclidean distance, provided that the various bells have uniform lengths, which however is rarely the case. An approximation in the case of monotonous speech, where the various bells have approximately the same lengths, can be effected by considering each bell as a short time sequence around its center point, and use a weighted Euclidean distance measure that emphasizes the central part of the bell in question. In addition, a compensation can be applied for the window function that has been used to obtain the bell function itself.

Other intermediate representations of a PSOLA bell can be useful. For example, a single bell can be considered as a combination of a causal impulse response and an anti-causal impulse response. The impulse response can then be modelled by means of filter coefficients and further by using the techniques of the preceding section. Another alternative is to adopt a source-filter model for each PSOLA bell and apply vector quantization for the prediction coefficients and the estimated excitation signal.

Speech Generation

Speech generation has been disclosed in various documents, such as U.S. Ser. No. 07/924,863 (PHN 13801), U.S. Ser. No. 07/924,726 (PHN 13993), to U.S. Ser. No. 08/696,431 (PHN 15408), U.S. Ser. No. 08/778,795 (PHN 15641), all to the assignee of the present application.

FIG. 1 gives a known monopulse or LPC vocoder, according to the state of the art. Advantages of LPC are the extremely compact manner of storage and its usefulness for manipulating of speech so coded in an easy manner. A disadvantage is the relatively poor quality of the speech produced. Conceptually, synthesis of speech is by means of all-pole filter 54 that receives the coded speech and outputs a sequence of speech frames on output 58. Input 40 symbolizes actual pitch frequency, which at the actual pitch period recurrency is fed to item 42 that controls the generating of voiced frames. In contradistinction, item 44 controls the generating of unvoiced frames, that are generally represented by (white) noise. Multiplexer 46, as controlled by selection signals 48, selects between voiced and unvoiced. Amplifier block 52, as controlled by item 50, can vary the actual gain factor. Filter 54 has time-varying filter coefficients as symbolized by controlling item 56. Typically, the various parameters are updated every 5–20 milliseconds. The synthesizer is called mono-pulse excited, because there is only a single excitation pulse per pitch period. The input from amplifier block 52 into filter 54 is called the excitation signal. The input from amplifier block 52 into filter 54 is called the excitation signal. Generally, FIG. 1 is a parametric model, and a large data base has in conjunction therewith been compounded for usage in many fields of application.

Figure 2:
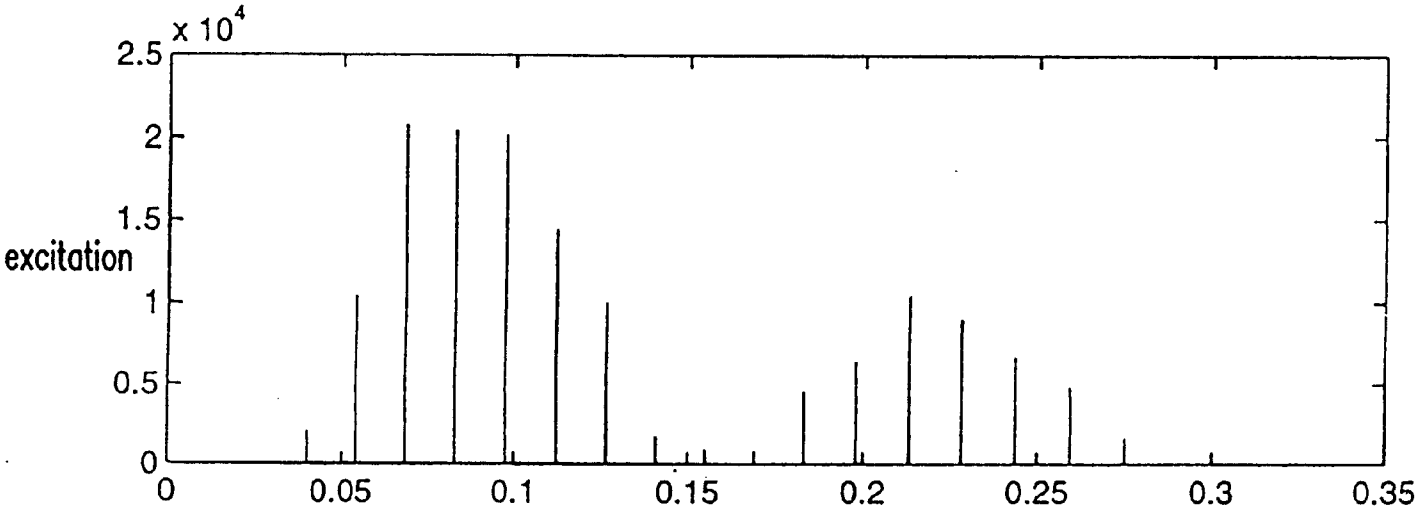
FIG. 2, excitation of such vocoder.
Figure 3:
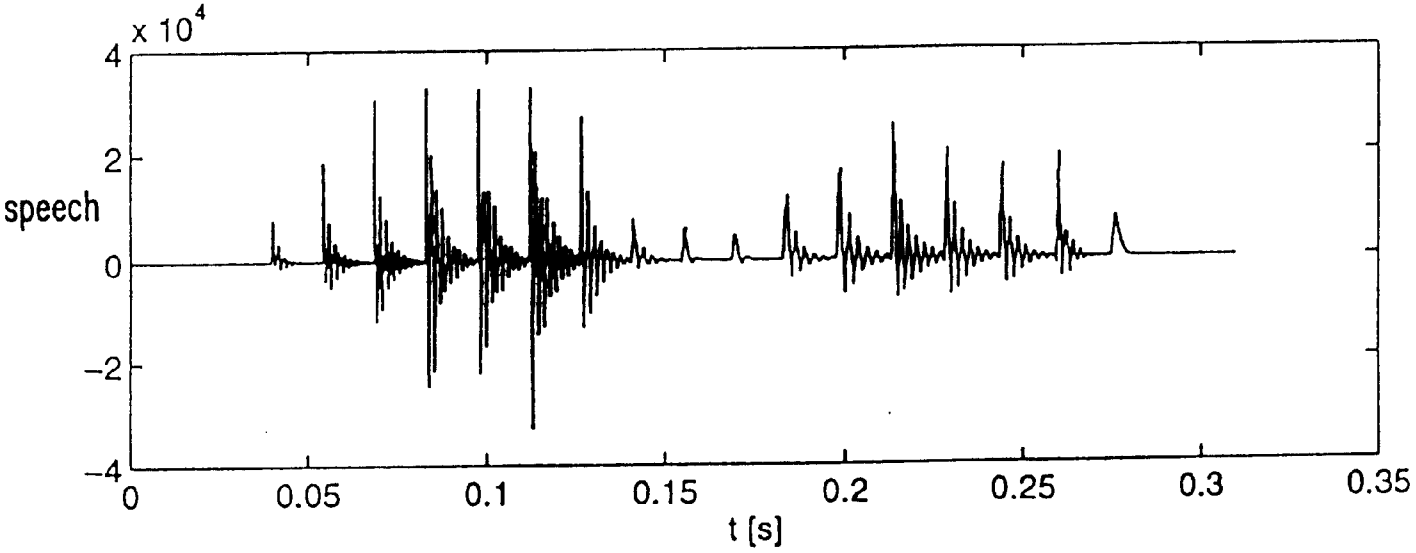
FIG. 3, an exemplary speech signal generated thereby.

FIG. 2 shows an excitation example of such vocoder and FIG. 3 an exemplary speech signal generated by this excitation, wherein time has been indicated in seconds, and instantaneous speech signal amplitude in arbitrary units. Clearly, each excitation pulse causes its own output signal packet in the eventual speech signal.

Figure 4:
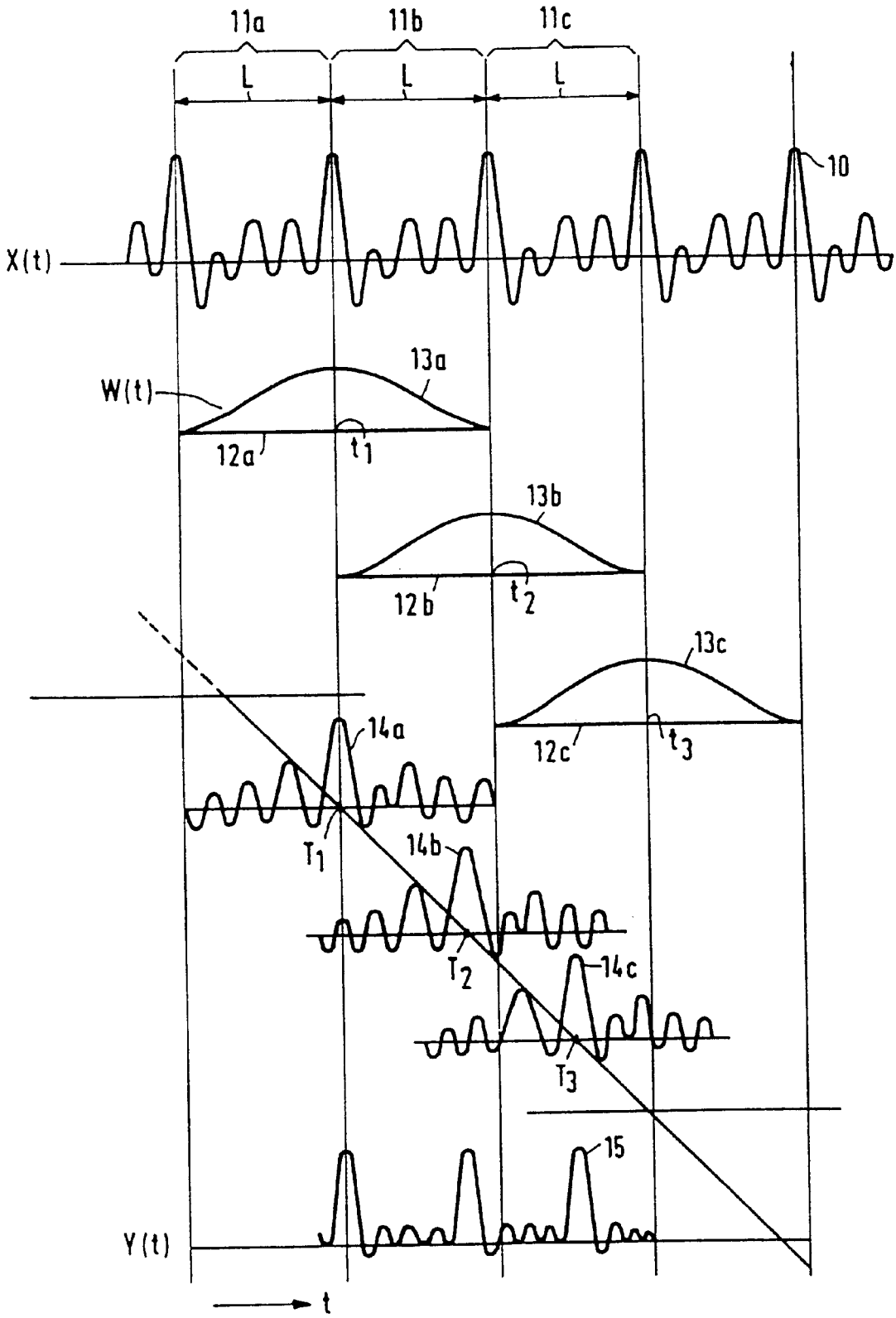
FIG. 4, windowing applied for pitch amendation.

FIG. 4 shows PSOLA-bell windowing used for pitch amending, in particular raising the pitch of periodic input audio equivalent signal "X" 10. This signal repeats itself after successive periods 11*a*, 11*b*, 11*c* . . . each of length L.

Successive windows 12*a*, 12*b*, 12*c*, centered at timepoints ti (i=1, 2, . . . ) are overlaid on signal 10. In FIG. 4, these windows each extend over two successive pitch periods L up to the central point of the next windows in either of the two directions. Hence, each point in time is covered by two successive windows. To each window is associated a window function W(t) 13*a*, 13*b*, 13*c*. For each window 12*a*, 12*b*, 12*c*, a corresponding segment signal is extracted from periodic signal 10 by multiplying the periodic audio equivalent signal inside the window interval by the window function. The segment signal Si(t) is then obtained according to:

$$Si(t)=W(t).X(to-ti)$$

The window function is self-complementary in the sense that the sum of the overlapping window functions is time-invariant: one should have W(t)+W(t−L)=constant, for t between 0 and L. A particular solution meeting this requirement is:

$$W(t)=½+A(t)\cos[180°t/L+\Phi(t)],$$

where A(t) and Φ(t) are periodic functions of time, with a period L. A typical window function is obtained through A(t)=½ and Φ(t)=0. Successive segments Si(t) are superposed to obtain the output signal Y(t) 15. However, in order to change the pitch, the segments are not superposed at their original positions ti, but rather at new positions Ti (i=1, 2, . . . ) 14*a*, 14*b*, 14*c*. In the Figure, the centers of the segment signals must be spaced closer in order to raise the pitch value, whereas for lowering they should be spaced wider apart. Finally, the segment signals are summed to obtain the superposed output signal Y15, for which the expression is therefore $$Y(t)=\Sigma i'Si(ti-Ti),$$

which sum is limited to time indices for which −i<t−Ti<L. By nature of its construction, the output signal Y(t) 15 will be periodic if the input signal is periodic, but the period of the output signal differs from the input period by a factor $$(ti-t(i-1)/(Ti-T(i-1)),$$

that is, as much as the mutual compression of the distances between the segments as they are placed for the superposition 14*a*, 14*b*, 14*c*. If the segment distance is not changed, the output signal Y(t) will reproduce exactly the input audio equivalent signal X(t).

Figure 5:
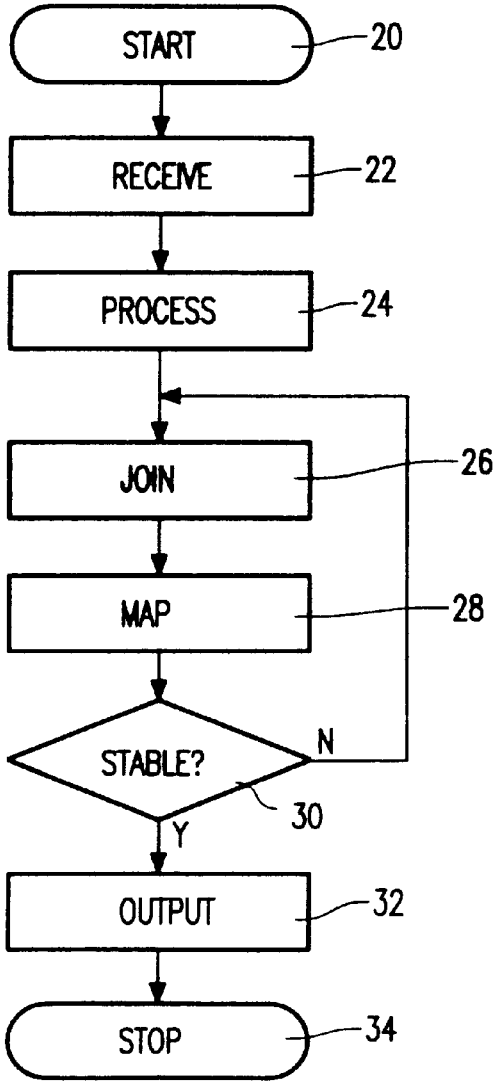
FIG. 5, a flow chart for constituting a data base.

FIG. 5 is a flow chart for constituting a data base according to the above procedure. In block 20, the system is set up. In block 22, all speech segments to be processed are received. In block 24, the processing is effected, in that the segments are fragmented into consecutive frames, and for each frame the underlying set of speech parameters is derived. The organization may have a certain pipelining organization, in that receiving and processing take place in an overlapped manner. In block 26, on the basis of the various parameters sets so derived, the joining of the speech frames takes place, and in block 28, for each subset of joined frames, the mapping on a particular storage frame is effected. This is effected according to the principles set out herebefore. In block 30, it is detected whether the mapping configuration has now become stable. If not, the system goes back to block 26, and may in effect traverse the loop several times. When the mapping configuration has however become stable, the system goes to block 32 for outputting the results. Finally, in block 34 the system terminates the operation.

Figure 6:
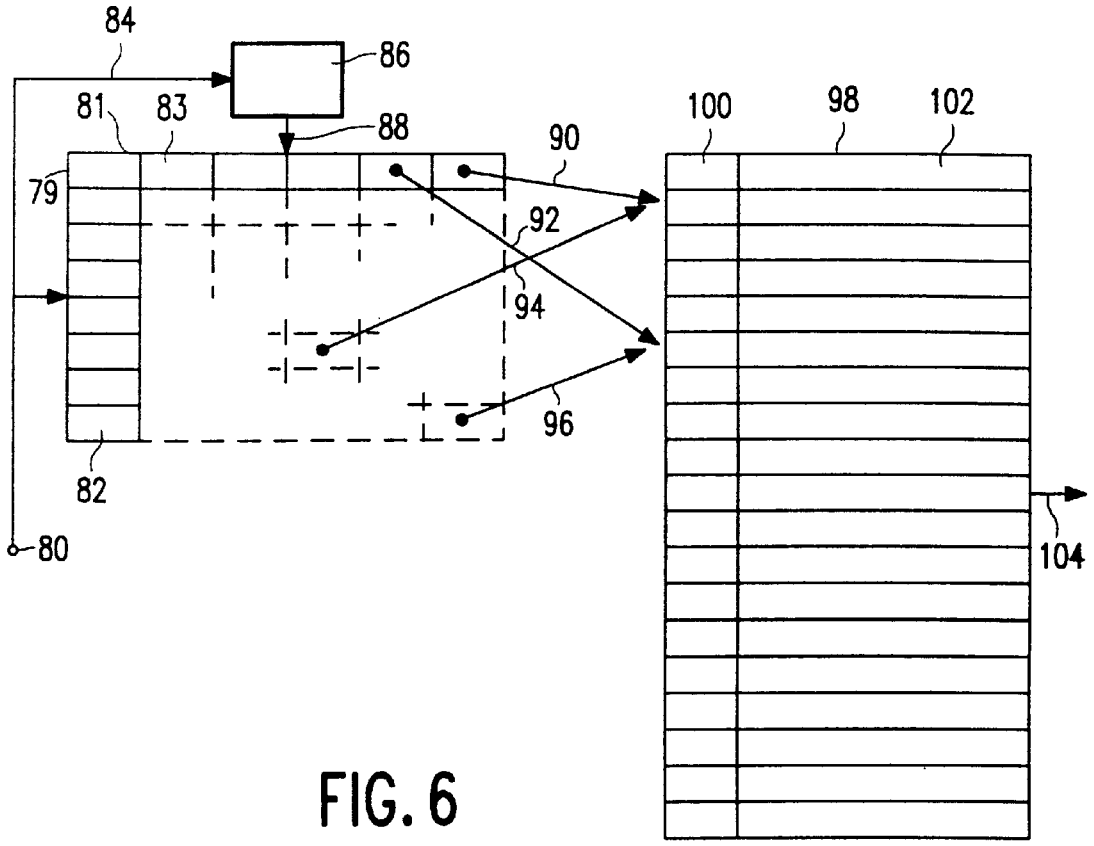
FIG. 6, two step addressing organization of a codebook.

FIG. 6 shows a two-step addressing mechanism of a code book. On input 80 arrives a reference code for accessing a particular segment in front store 81; such addressing can be absolute or associative. Each segment is stored therein at a particular location that for simplicity has been shown as one row, such as row 79. The first item such as 82 thereof is reserved for storing a row identifier, and further qualifiers as necessary. Subsequent items store a string of frame pointers such as 83. After pointing to one of the rows in front store 81, sequencer 86, that via line 84 can be activated by the received reference code or part thereof, successively activates the columns of the front store. Each frame pointer when activated through sequencer 86, causes accessing of the associated item in main store 98. Each row of the main store contains, first a row identifier such as item 100, together with further qualifiers as necessary. The main part of the row in question is devoted to storing the necessary parameters for converting the associated frame to speech. As shown in the Figure, various pointers from the front store 81 can share a single row in main store 98, as indicated by arrow pairs 90/94 and 92/96. Such pairs have been given by way of elementary example only; in fact, the number of pointers to a single frame may be arbitrary. It can be feasible that the same joined frame is addressed more than once by the same row in the front store. In the above manner the totally required storage capacity of main store 98 is lowered substantially, thereby also lowering hardware requirements for the storage organization as a whole. It may occur that particular frames are only pointed at by a single speech segment. For proper sequencing, the last frame of a segment in storage part 81 may contain a specific end-of-frame indicator that causes a return signalization to the system for so activating the initializing of a next-following speech segment.

Figure 7:
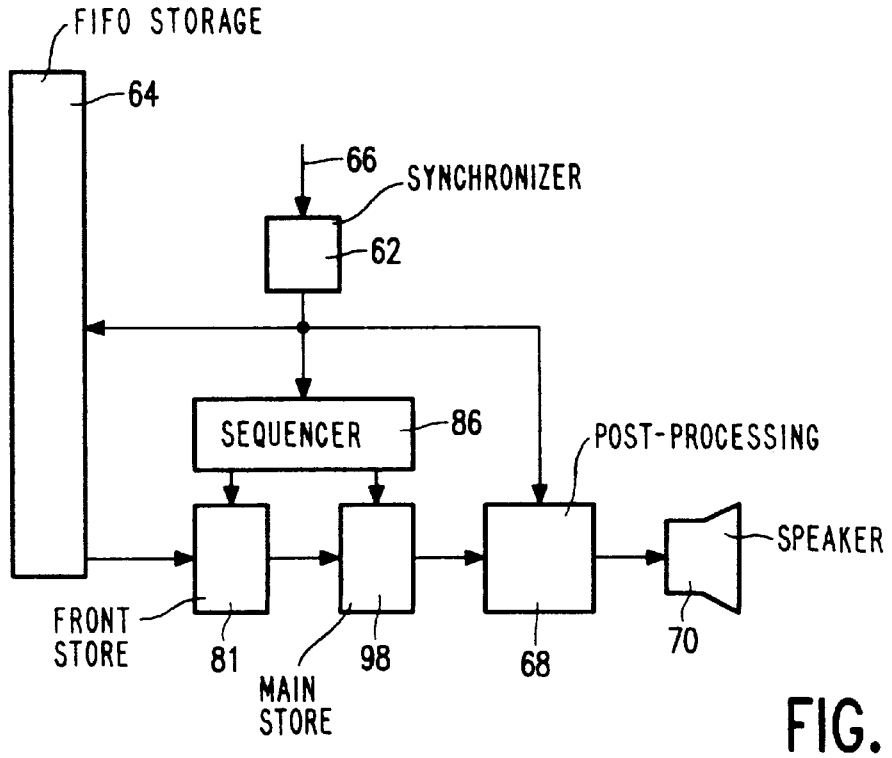
FIG. 7, a speech reproducing apparatus.

FIG. 7 is a block diagram of a speech reproducing apparatus. Block 64 is a FIFO-type store for storing the speech segments such as diphones that must be outputted in succession. Items 81, 86 and 98 correspond with like-numbered blocks in FIG. 6. Block 68 represents the post-processing of the audio for subsequent outputting through loudspeaker system 70. The post-processing may include amending of pitch and/or duration, filtering, and various other types of processing that by themselves may be standard in the art of speech generating. Block 62 represents the overall synchronization of the various subsystems. Input 66 may receive a start signal, or, for example, a selecting signal between various different messages that can be outputted by the system. Such selection should then also be communicated therefrom to block 64, such as in the form of an appropriate address.

We claim:

1. A method for coding human speech for subsequent audio reproduction thereof, said method comprising the steps of deriving a plurality of speech segments from speech received, and systematically storing said segments into a data base for later concatenated readout, characterized in that said speech segments are of non-uniform length and, after said step of deriving, (a) respective speech segments are fragmented into temporally consecutive source frames of uniform length, (b) similar source frames as governed by a predetermined similarity measure thereamongst that is based on an underlying parameter set are identified and joined, (c) joined source frames are collectively mapped onto a single storage frame, and (d) respective segments a restored as containing sequenced referrals to storage frames for therefrom reconstituting the segment in question.

2. A method as claimed in claim 1, wherein the segments are stored in the form of a representation of the associated source frames that provide the associated similarity measure.

3. A method as claimed in claim 1, based on LPC-parameter coding of the frames.

4. A method as claimed in claim 1, wherein the similarity measure is based on calculating a distance quantity:

$$D(\underline{a}_k, \underline{a}_1) = \frac{1}{2\pi}\int_{-\pi}^{\pi}\left|\frac{A_k(\exp(j\theta))}{A_l(\exp(j\theta))}\right|^2 d\theta \times \sigma_l^2,$$

wherein $$A_k(z) = 1 + \sum_{m=1}^{p_k} a_{k,m} z^{-m},$$

indicating how well $a_k$ performs as a prediction filter for a signal with a spectrum given by $\{1/|A_l(\exp(j\theta))|^2\}$.

5. A method as claimed in claim 4, wherein the 1-dependent variance factor $\sigma_l^2$ is assumed equal to 1.

6. A method as claimed in claim 1, wherein a code book is generated as a set of code sub-books that each pertain to a respective subset of the prediction vectors.

7. A method as claimed in claim 1, wherein said segments are excised under control of belled windows that are staggered in time as based on an instantaneous pitch period of the received speech.

* * * * *